United States Patent [19]

Hansen et al.

[11] Patent Number: 4,612,886

[45] Date of Patent: Sep. 23, 1986

[54] INTERNAL COMBUSTION ENGINE WITH ROTARY COMBUSTION CHAMBER

[75] Inventors: Craig N. Hansen, Minnetonka; Paul C. Cross, Minneapolis, both of Minn.

[73] Assignee: Hansen Engine Corporation, Minnetonka, Minn.

[21] Appl. No.: 671,573

[22] Filed: Nov. 15, 1984

[51] Int. Cl.[4] ..... F01L 7/10

[52] U.S. Cl. ..... 123/190 B; 123/190 D; 123/80 BB

[58] Field of Search ..... 123/190 R, 190 B, 190 D, 123/190 C, 190 E, 80 BB, 80 D, 80 DA

[56] References Cited

U.S. PATENT DOCUMENTS

| | | | |
|---|---|---|---|
| 1,042,712 | 10/1912 | Moorhead . | |
| 1,170,769 | 2/1916 | Mayfield . | |
| 1,215,993 | 2/1917 | Rimbach . | |
| 1,292,597 | 1/1919 | Gill . | |
| 1,581,942 | 4/1926 | Rich . | |
| 1,632,517 | 6/1927 | Stickney | 123/190 D |
| 1,651,207 | 11/1927 | Hodges . | |
| 1,692,235 | 11/1928 | Wehr . | |
| 1,700,862 | 2/1929 | Thompson . | |
| 1,719,508 | 7/1929 | Good | 123/190 D |
| 1,724,458 | 8/1929 | Davidson . | |
| 1,733,946 | 10/1929 | Meester, Jr. . | |
| 1,758,242 | 5/1930 | Wehr . | |
| 1,782,389 | 11/1930 | Rauha, Jr. et al. . | |
| 1,971,060 | 8/1934 | Wills | 123/190 E |
| 2,017,196 | 10/1935 | Anglada et al. | 123/190 E |
| 2,222,059 | 11/1940 | Monleone . | |
| 2,245,743 | 6/1941 | Aspin | 123/190 D |
| 2,437,181 | 3/1948 | Baker . | |
| 2,471,941 | 5/1949 | Downey . | |
| 2,500,794 | 3/1950 | Boyce | 123/80 D |
| 2,730,088 | 1/1956 | Hyde . | |
| 3,039,448 | 6/1962 | Stucke . | |
| 3,130,953 | 4/1964 | Carpenter . | |
| 3,395,680 | 8/1968 | Brooks . | |
| 4,019,488 | 4/1977 | Kremer . | |
| 4,036,184 | 7/1977 | Guenther . | |
| 4,311,119 | 1/1982 | Menzies | 123/80 BB |
| 4,404,934 | 9/1983 | Asaka et al. . | |
| 4,494,500 | 1/1985 | Hansen | 123/80 BB |

FOREIGN PATENT DOCUMENTS

| | | | |
|---|---|---|---|
| 492380 | 3/1954 | Italy | 123/80 D |
| 401985 | 11/1933 | United Kingdom . | |

*Primary Examiner*—Ronald H. Lazarus

*Attorney, Agent, or Firm*—Burd, Bartz & Gutenkauf

[57] ABSTRACT

An internal combustion engine having a head with valve assemblies for controlling intake and exhaust gases to and from piston chambers. A head plate is located between the head and a block having cylinders accommodating pistons. The head plate has openings in communication with the cylinders and valve assemblies. Each valve assembly has a continuous ceramic sleeve having an intake port, an exhaust port, and ignition hole. Rotatably disposed within the sleeve is a rotatable valve body having a valving combustion chamber open to a piston chamber. A ceramic segment seal member mounted on the valving body has sealing surfaces engageable with the sleeve. A face seal is located between the head plate and the rotating valve body. The valving body and seal member are rotatably driven to sequentially align the valving combustion chamber with the intake port, ignition hole, and exhaust port during the operation of the engine.

71 Claims, 16 Drawing Figures

INTERNAL COMBUSTION ENGINE WITH ROTARY COMBUSTION CHAMBER

This invention was made with Government support under contract No. DAAE 07-84-C-R-089 awarded by the Department of Army. The Government has certain rights in this invention.

FIELD OF INVENTION

The invention pertains to a rotary valve assembly usable with an internal combustion engine, fluid motor, or gas compressor to control the flow of intake and exhaust gas.

BACKGROUND OF INVENTION

Rotary valves have been proposed for use with internal combustion engines. These valves have valving members drivably connected to the crankshafts of the engines to sequentially allow intake gas, such as an air and fuel mixture, to flow into the engine and exhaust gas to flow out of the engine. An example of a rotary valve mechanism for an internal combustion engine is described by Carpenter in U.S. Pat. No. 3,130,953. This valve mechanism has a rotary valve body rotatably located in a head. The head is mounted atop a cylinder. A self-sealing split sleeve device associated with the body functions as a valving member and seal. The sleeve is a metal cylindrical member having a hole and a longitudinal split. In use the sleeve deforms outwardly into circumferential surface sealing engagement with an inside cylindrical wall of the head to close the intake and exhaust ports. Hodges in U.S. Pat. No. 1,651,207 discloses an internal combustion engine having a rotary valve located over the piston. The valve has a port open to the piston chamber that is sequentially moved into alignment with intake, ignition and exhaust ports. The outer surface of the valve is in surface engagement with the head.

Ceramic materials have been developed for parts of turbine engines and internal combustion engines. Engine designs must accommodate the mechanical, heat, and lubricating characteristics of the ceramic materials. The rotary valve assembly of the present invention has ceramic parts that are compatible with the material of the head, cylinder, and piston of the engine.

SUMMARY OF INVENTION

The invention is directed to rotary valve assemblies and a head for an apparatus, as an internal combustion engine or a gas compressor, having rotary valve assemblies for controlling intake and exhaust gases. The valve assemblies are usable as a substitute for the conventional poppet valves and cam shaft arrangements used in internal combustion engines. The valve assemblies have a simplified construction which can be readily serviced and maintained. In operation, the valve assemblies are usable with high speed engines and gas compressors. The conventional problem with valve float associated with poppet valves is not present in the rotary valve assembly.

The internal combustion engine has a block with a plurality of bores accommodating reciprocating pistons. These bores and pistons provide the piston or compression and expansion chambers for accommodating the burning air/fuel mixture and exhaust gases. The rotary valve assemblies are located in a head and are concurrently driven with a valve drive operatively connected to the crankshaft of the engine. A head plate has openings providing communication between the rotary valve assemblies and the piston compression and expansion chambers. The head plate reduces the thrust and lateral forces on the rotary valve assemblies and minimizes the quenched volume of air and fuel mixture adjacent to the valving combustion chambers. Substantially all of the air/fuel mixture in the valving combustion chamber is exposed to the flame front with a result in reduction of HC emissions and improved fuel economy. A spark generating means is mounted on the head and extended into the ignition hole to ignite the air/fuel mixture in the valving combustion chamber. A fuel injector can be mounted on the head in lieu of the spark plug when the engine is a Diesel engine, or in conjunction with spark generating means in the case of a fuel injected spark ignition engine.

The head has a plurality of bores open to the piston compression and expansion chambers in the block. The bores can be larger than the openings in the head plate. Intake and exhaust gas passages located in the head are open to separate portions of each bore. Each bore accommodates a continuous sleeve having an intake port, an exhaust port, and an ignition hole and/or fuel injection port. The intake and exhaust ports are aligned with the intake and exhaust gas passages. The sleeve is a cylindrical member having a cylindrical inner surface. The sleeve can be made of ceramic material.

A rotatable valving means having a valving combustion chamber open to both the piston chamber and the inner surface of the sleeve is located within each sleeve. Each valving means includes a rotary valve body located within the sleeve. The valve body has an outside cylindrical wall positioned in spaced contiguous relationship to the inside wall of the sleeve. The valve body is rotatably mounted in the head with low friction bearings. The valve body has a rotatable valving combustion chamber for accommodating air/fuel mixture and exhaust gases. A segment seal mounted on the valve body is located in sealing relation with the inside surface of the sleeve. The segment seal has a pressure activated ring seal which bears against the valve body. The pressure activation provides a minimum of friction of the segment seal with the sleeve and allows for the less stringent machining tolerances of the valve body. A second pressure activated seal is interposed between the head plate and bottom of the valve body.

The rotary valve assembly provides for an air/fuel stratification toward the outer portions of the valving combustion chamber when fuel is mixed with the air prior to or during intake. This enhances the ignition of the air/fuel mixture and allows for an overall relatively lean air/fuel mixture. The rotary valve body causes circulation and turbulence of the air/fuel mixture in the piston chamber. Pre-ignition and end gas detonations are reduced.

The rotary valve assemblies can be directly removed from the head. The head and its attendant intake and exhaust manifolds and cooling system need not be removed from the engine in order to provide access to the valve assemblies. Neither initial installation nor accumulated wear affects require adjustment of the valve parts. All fits and clearances are established by manufactured dimensions such that the initial assembly consists of simple synchronization indexing of the valve drive shaft and valve bodies.

DESCRIPTION OF PREFERRED EMBODIMENT

Figure 1:
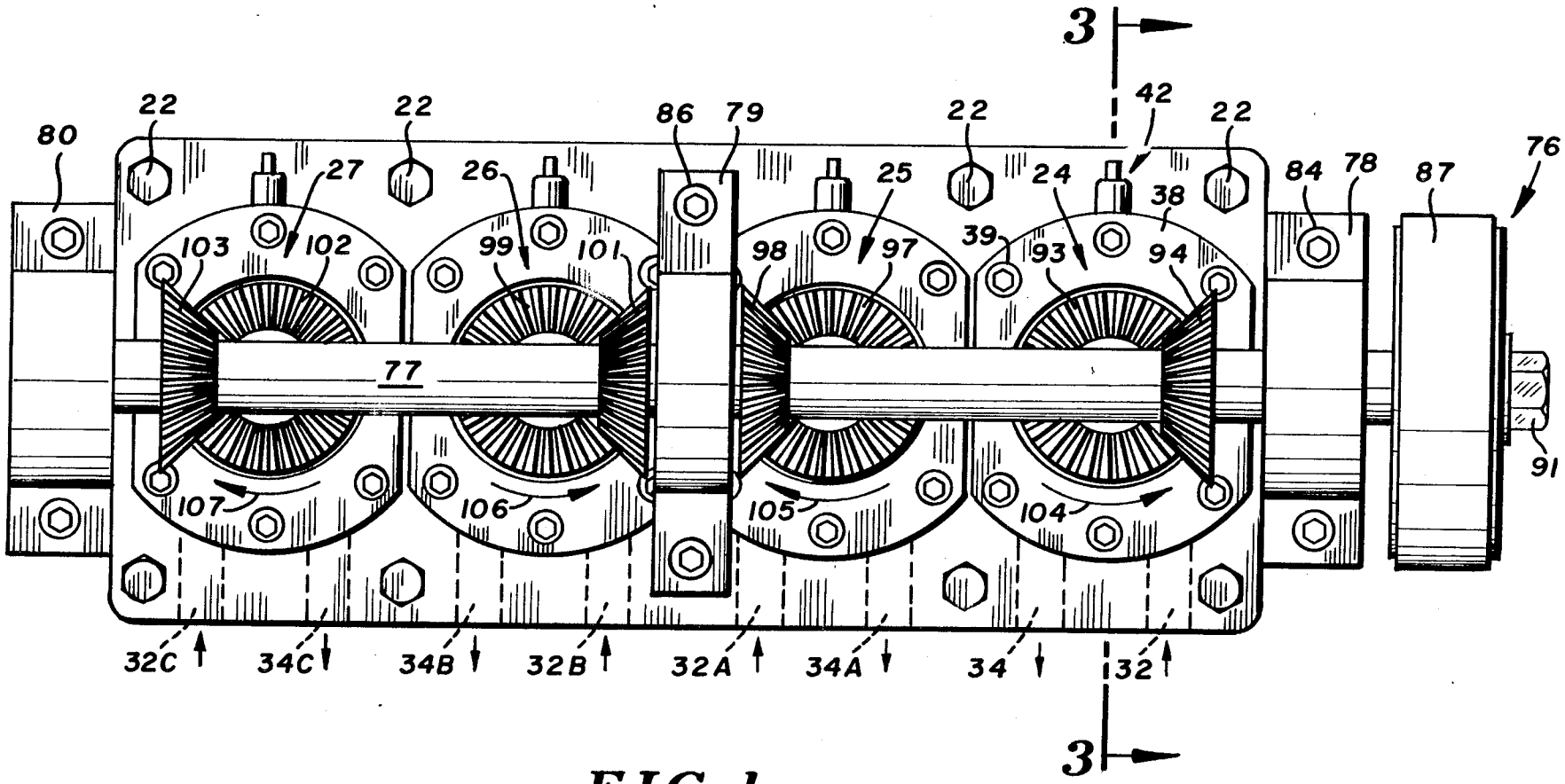
FIG. 1 is a top view of an internal combustion engine equipped with the rotary valve assemblies of the invention.
Figure 2:
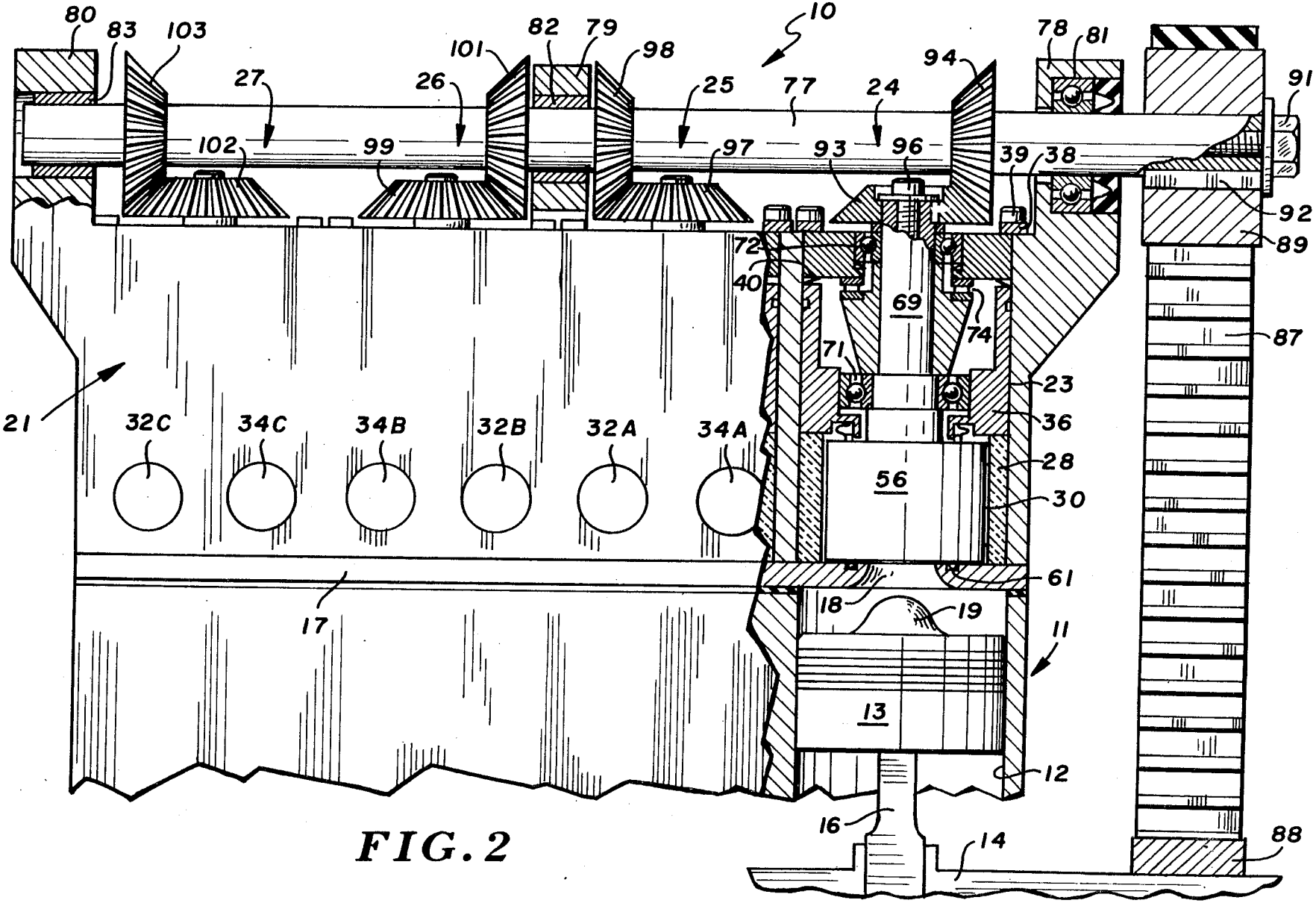
FIG. 2 is a side view, partly sectioned, of the engine of FIG. 1.

Referring to FIGS. 1 and 2 there is shown an internal combustion engine indicated generally at 10 equipped with rotary valve assemblies 24, 25, 26 and 27 having rotary valving combustion chambers. The air/fuel mixture in the rotary valving combustion chambers stratifies to allow effective ignition in lean burn environments. The air/fuel mixture in the rotary valving combustion chambers has circulation and turbulence providing an effective and efficient propagation of the flame front in the combustion chamber and piston chamber. Engine 10 has a block 11 having four upright cylinders or bores 12. The number of bores in block 11 can vary according to the design of the engine. Each of the bores accommodates a piston, such as piston 13. Piston 13 is slidably located in bore 12 and connected to a conventional crankshaft 14 with a connecting rod 16. As shown in FIG. 2, a head plate 17 is located on top of block 11. Head plate 17 has an opening 18 aligned with the central vertical axis of bore 12. Head plate 17 reduces the thrust and lateral forces on the valve assemblies and reduces the quenched volume of the air/fuel mixture adjacent to the valving combustion chambers. Substantially all of the air/fuel mixture in the valving combustion chambers is exposed to the flame front with a result in reduction of HC emissions and improved fuel economy. Piston 13 has an upwardly directed central projection 19 that is located in opening 18 when piston 13 is at top dead center or at the completion of the compression stroke. Projection 19 increases the compression of the air/fuel mixture in the rotary valving combustion chamber, and facilitates a generally cylindrical expanding flame front over the top of piston 13 during the power stroke. Pistons without projections 19 can be used in the internal combustion engine.

A head indicated generally at 21 is located on top of head plate 17. A plurality of head bolts 22 secure head 21 and head plate 17 to block 11. Head 21 has a plurality of vertical bores 23 accommodating rotary valve assemblies indicated generally at 24, 25, 26 and 27 for directing the flow of air/fuel mixture into the rotary valving combustion chambers, exposing the air/fuel mixture to an ignition spark, and controlling the flow of exhaust gases out of the valving combustion chambers and piston chambers. Rotary valve assemblies 24, 25, 26, 27 are identical in structure and function. The following description is directed to rotary valve assembly 24.

Figure 3:
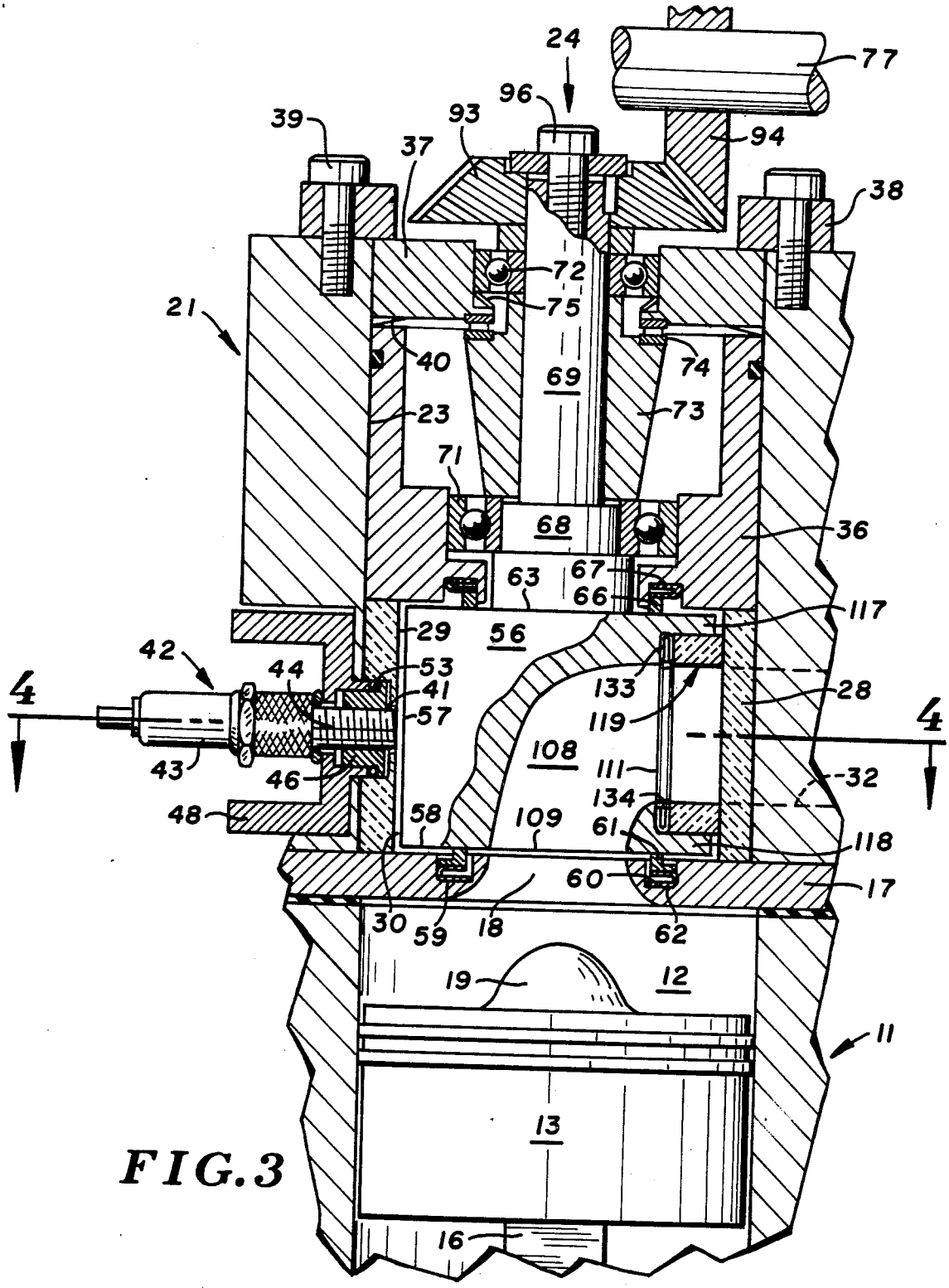
FIG. 3 is an enlarged sectional view taken along the line 3—3 of FIG. 1.
Figure 4:
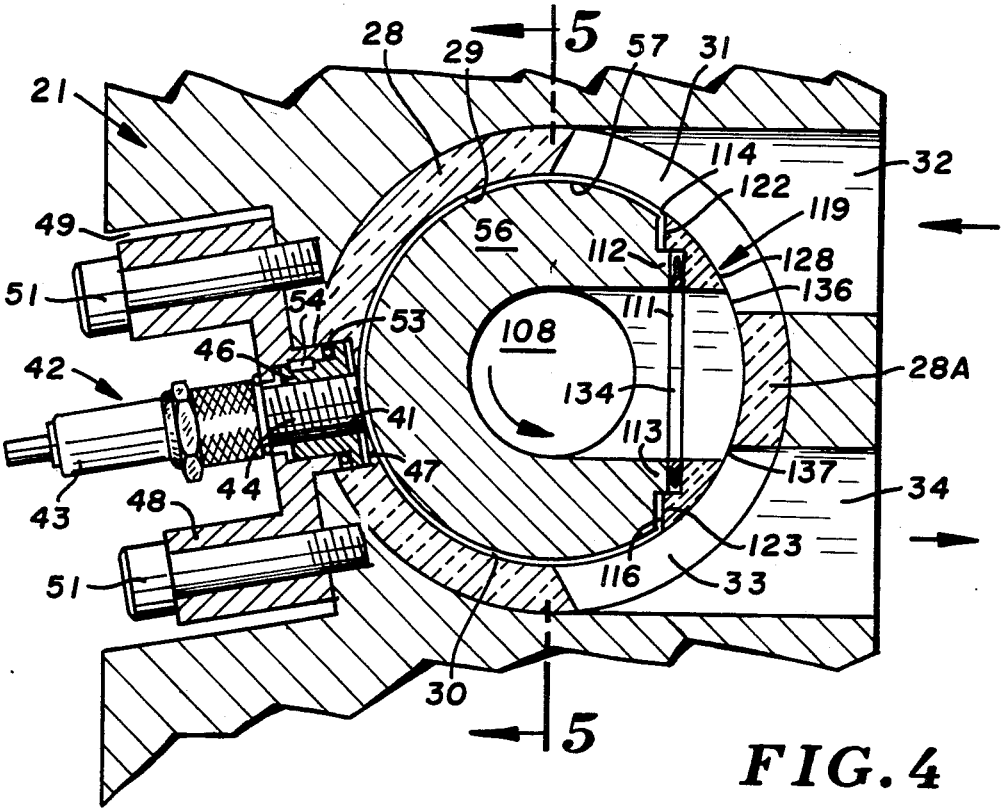
FIG. 4 is a sectional view taken along the line 4—4 of FIG. 3.

Referring to FIGS. 3 and 4, rotary valve assembly 24 has a cylindrical sleeve 28 positioned in the bottom of bore 23. The lower end of sleeve 28 bears against head plate 17. Sleeve 28 is a circular cylindrical member having an inside cylindrical surface 29, an intake port 31, and exhaust port 33. Intake port 31 is aligned with intake passage 32 located in head 21. Sleeve 28 can be removed from bore 23 to facilitate servicing and repair of the engine. The location of the edges of the sleeves forming the intake port 31 and exhaust port 33 can be changed to adjust the timing of the valve events as hereinafter described. Replacement of sleeve 28 with an alternative sleeve which has appropriate edge locations allow the engine to be designed for different efficient operating speeds. Sleeve 28 can be a ceramic material, such as silicon nitride, silicon carbide, or a ceramic including silicon, aluminum, oxygen, nitrogen, and other materials. A sleeve 28 of ceramic material functions as a head insulator to restrict the dissipation of heat to head 21. Sleeve 28 can also be made of other materials, such as metal, carbon or the like.

Returning to FIG. 2, head 21 has additional intake passages 32A, 32B, 32C and exhaust passages 34A, 34B, and 34C for the rotary valve assemblies 25, 26, and 27. Intake and exhaust manifolds (not shown) are used to supply an air/fuel mixture or air to the intake passages 32, 32A, 32B, and 32C and carry exhaust gases to an emission control and sound suppression device. Returning to FIG. 3, sleeve 28 is held in a fixed position against head plate 17 by members 36 and 37 located in bore 23. A spring washer 40 located between members 36 and 37 allows for thermal growth of head 21 relative to sleeve 28. A ring 38 surrounding member 37 holds members 36 and 37 and washer 40 in bore 23. A plurality of bolts 39 secure ring 38 to the top of head 21. Ring 38 is removable from head 21 to allow the entire valve assembly to be withdrawn from head 21. This is accomplished without removal of head 21 from block 11 or removal of the intake and exhaust manifolds.

Sleeve 28 has an ignition opening 41 generally opposite intake and exhaust ports 31 and 33. A spark plug 42 has its ignition end 44 located in hole 41 to ignite an air/fuel mixture. Spark plug 42 has a body and a threaded ignition end 44. As shown in FIG. 4, end 44 is threaded into a nut 46 located within an outer recess 47 in sleeve 28. The inner part of ignition end 44 is located substantially flush with the inside surface 29 of sleeve 28. Nut 46 is held in a support 48 located within a recess 49 in head 21. The plurality of bolts 51 secure support 48 to head 21. A ring seal 53 is interposed between nut 46 and support 48. A key 54 between nut 46 and support 48 prevents nut 46 from turning relative to support 48. The spark plug 42 when turned into nut 46 relative to sleeve 28. Nut 46 does not apply an axial load on sleeve 28 whereby the sleeve is not distorted. Nut 46 also prevents the sleeve 28 from rotating in bore 23. Spark plug 42 can be replaced with a fuel injector (not shown). The combustion would be compression ignition in the rotary valving combustion chamber. Alternatively, a fuel injection nozzle and spark plug can be used in lieu of spark plug 42 to provide a fuel injection engine with spark ignition for the air/fuel mixture in the rotary valving combustion chamber. An example of a suitable fuel injector and igniter is disclosed by Rank in U.S. Pat. No. 3,648,669.

Figure 5:
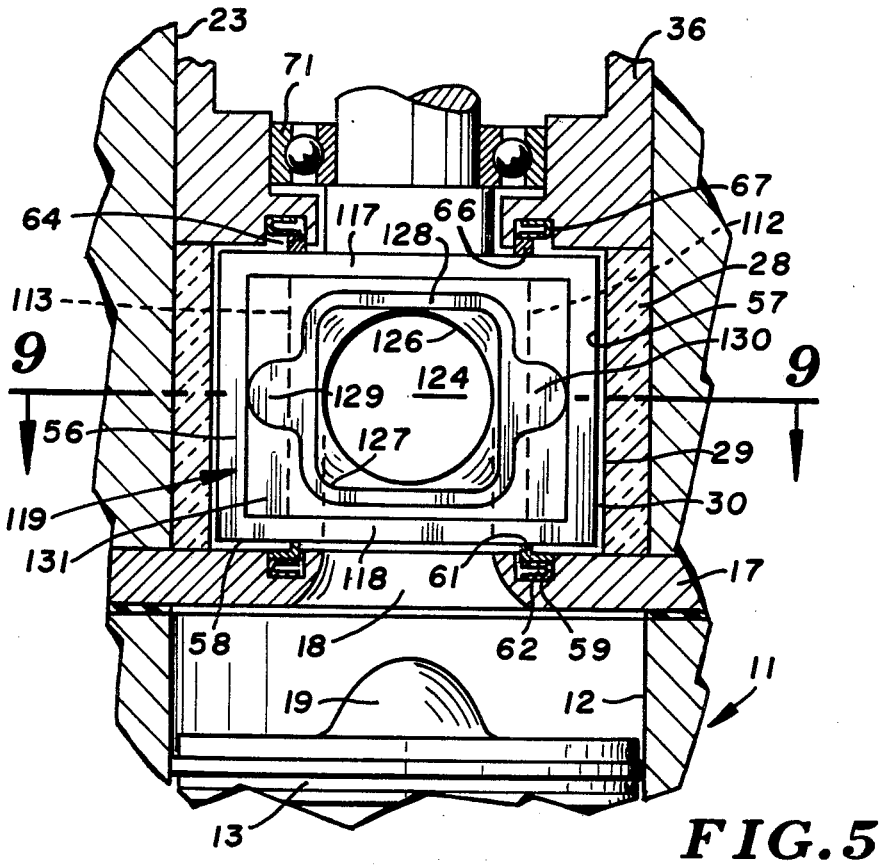
FIG. 5 is a sectional view taken along the line 5—5 of FIG. 4 with a side view of the rotary valve body and seal.

A cylindrical valve body 56 is located within sleeve 28. Body 56 has an outside cylindrical wall 57 located in spaced contiguous relation relative to inside wall 29 of sleeve 28. An annular cylindrical space 30 separates the outside cylindrical wall 57 of body 56 from inside wall 29 of sleeve 28. Wall 57 does not have a precise machine finish as it does not engage wall 29 of sleeve 28. There is no frictional relationship between the walls 57 and 29. The bottom of body 56 has a flat wall 58 facing head plate 17. Wall 58 can have a ceramic coating to enhance its wear characteristics. As shown in FIGS. 3 and 5, head plate 17 has a circular groove 59 surrounding opening 18. A ring seal 61 located in groove 59 is biased with a circular spring 62 into engagement with bottom wall 58 of body 56. Seal 61 is a pressure active face seal that has a high unit load on bottom wall 58 during the compression and power strokes of the piston. The high unit load is affected by transfer of high pressure gases in the annular seal chamber 60 surrounded by circular spring 62. Seal 61 is preferably ceramic material. Alternatively, a split ring located in an annular groove in head plate 17 engageable with seal 61 and a spring in the groove can be used to hold seal 61 in engagement with the bottom of body 56. Further, seal 61 can be replaced by a split ring. A spring can be used to bias the split ring into engagement with the bottom of body 56.

Body 56 has a generally flat top wall 63 facing the bottom of member 36. Member 36 has a downwardly open circular groove 64 accommodating a sealing ring 66 and a circular spring 67. Spring 67 biases sealing ring 66 into sealing engagement with top wall 63. Sealing ring 66 can be a conventional circular oil seal.

A cylindrical hub integral with the top of body 56 is secured to an upright cylindrical shaft 69. A first low friction ball bearing 71 is interposed between hub 68 and member 36. A second ball bearing 72 is interposed between shaft 69 and member 37. Bearings 71 and 72 rotatably mount body 56 for rotation about a generally vertical axis aligned with the vertical axis of piston bore 12. A sleeve 73 surrounding shaft 69 is located between bearings 71 and 72. A thrust bearing 74 is interposed between sleeve 73 and member 37 to maintain the axial position of body 56 within sleeve 28 as shown in FIG. 3. An annular spring 75, such as a bevel washer, is located between member 37 and bearing 72. Spring 75 axially pre-loads valve body 56 against thrust bearing 74 to minimize impact forces on the bearings, allow for thermal growth, and allow for less stringent machining tolerance.

Returning to FIGS. 1 and 2, a valve body drive indicated generally at 76 is operable to rotate the valve bodies in a two to one timed relation with the rotation of crankshaft 14. Drive 76 has shaft 77 rotatably supported on top of head 21. Bearing supports 78, 79 and 80 accommodate bearings 81, 82 and 83 respectively for rotatably positioning shaft 77 longitudinally overhead 21. Bearings 81 or 82 can be a bidirectional thrust bearing to accommodate the axial loads on shaft 77. Bearing supports 78, 79 and 80 are two-part structures accommodating bearings 81, 82, and 83. Bolts 84 and 86 hold bearing support 78 and 79 on head 21. Shaft 77 is drivably connected to crankshaft 14 with an endless timing belt 87. Belt 87 is trained about a first tooth pulley 88 mounted on crankshaft 14 and second tooth pulley mounted on shaft 77. A bolt 91 maintains pully 89 on shaft 77. A key 92 drivably connects pulley 89 to shaft 77. Shaft 77 can be drivably connected to crankshaft 14 with a gear drive or chain drive. A pair of bevel gears 93 and 94 drivably connect shaft 77 to valve shaft 69. Bevel gear 93 is mounted on the upper end of shaft 69 and retained thereon with a bolt 96. Bevel gear 94 is fixed to shaft 77. Bevel gear pairs 97, 98, 99, 101, 102, and 103 are drivably connected to shaft 77 to the valve shafts of valve assemblies 25, 26 and 27 respectively. On rotation of shaft 77, the valve bodies of the valve assemblies 24–27 are rotated in the direction of the arrows 104, 105, 106 and 107 as shown in FIG. 1.

As shown in FIG. 3, valve body 56 has a valving chamber or passage 108 for carrying air/fuel mixture to the piston compression and expansion chamber and exhausting exhaust gases therefrom. The passage 108 has a first open end 109 aligned with opening 18 in head plate 17. The opposite end 111 of passage 108 is open toward sleeve 28 and aligned with the intake and exhaust ports therein. As shown in FIG. 4, valve body 56 has a pair of upright shoulders 112 and 113 located adjacent opposite sides of open end 111. Upright grooves 114 and 116 are located adjacent the outer sides of shoulders 112 and 113. Shoulders 112 and 113 extend between a top lip 117 and a bottom lip 118 as shown in FIGS. 3 and 5.

A segment seal indicated generally at 119 is located between lips 117 and 118. Seal 119 has a pressure activated annular seal 133 that provides sealing forces proportional to the pressure acting within the seal on the surface of the segment seal located in engagement with sleeve 28. As the sealing forces increase, the contact unit loads increase correspondingly at all segment seal interfaces. Conversely, as the pressure acting within the segment seal decreases, the sealing force and resulting unit loads decrease. Seal 119 is free to move to accommodate relative run out between valve body 56 and ported sleeve 28 such that segment seal 119 maintains constant surface contact with the inside surface of the sleeve. Segment seal 119 insures that the annular clearance 30 between valve body 56 and the sleeve 28 is not filled with a fuel/air mixture. This substantially reduces the unburned fuel/air mixture in the valve assembly.

Figure 6:
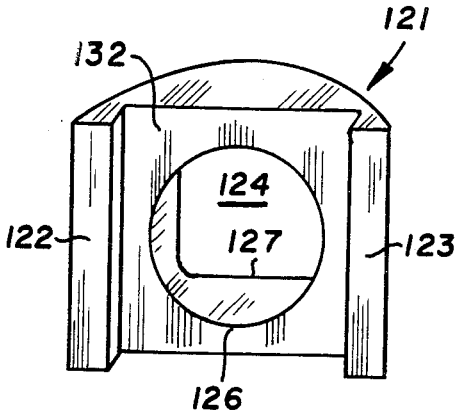
FIG. 6 is a perspective view of the seal for a rotary valve assembly of the engine of FIG. 1.
Figure 7:
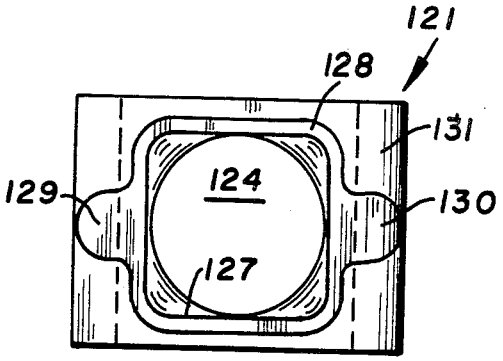
FIG. 7 is a front view of the seal of FIG. 6.
Figure 8:
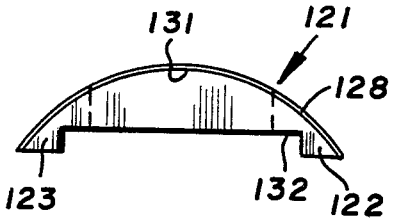
FIG. 8 is a top view of the seal of FIG. 6.
Figure 9:
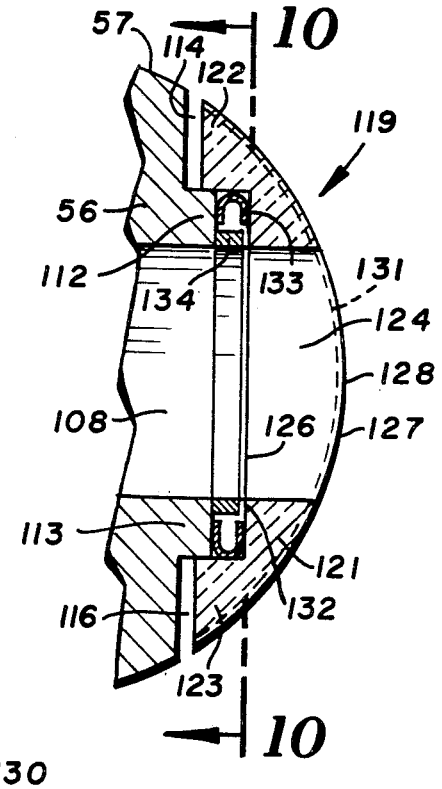
FIG. 9 is an enlarged sectional view taken along the line 9—9 of FIG. 5.
Figure 10:
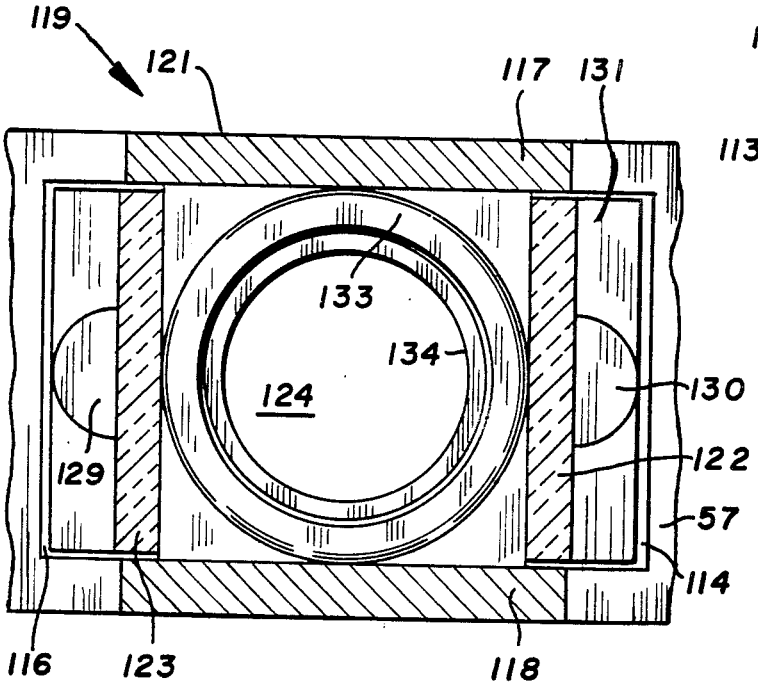
FIG. 10 is a sectional view taken along the line 10—10 of FIG. 9.

Referring to FIGS. 6 to 10, segment seal 119 has a one-piece ceramic body 121 having a pair of upright tongues 122 and 123. Tongues 122 and 123 project into grooves 114 and 116 and engage outer edges of shoulders 112 and 113. Body 121 has flat upper and lower surfaces that engage the top and bottom lips 117 and 118. Segment 119 has a center hole 124 in communication with valving combustion chamber 108. Center hole 124 has a circular inner end 126 and a generally square outer end 127. As shown in FIGS. 5 and 7, an arcuate outer surface 128 surrounds the square outer end 127. Arcuate surface 128 has lateral central arcuate extensions 129 and 130, which maintains gas-tight seals while body 121 transitions past ignition opening 41 in sleeve 28. The arcuate configurations of surfaces 128 to 130 generally conforms to the arcuate inner surface 29 of sleeve 28. As shown in FIG. 4, arcuate surface 128 is in surface contact with surface 29. The remaining outer surface of body 121 is a relieved arcuate surface 131. The surface 131 has a configuration such that it is not in surface contact with inner surface 29 of sleeve 28. FIG. 8 emphasizes the relief or separation of surface 131 relative to the surface of 128. As shown in FIG. 6, body 121 has a flat inner wall 132 surrounding circular opening 126. Referring to FIGS. 9 and 10, a circular seal 133 is interposed between inner wall 132 and body 56. Seal 133 is a circular biasing seal member having a generally U-shaped cross section. Seal 133 functions to bias body 121 into sealing engagement with the inner surface 29 of sleeve 28. A circular band or shield 134 is located concentrically inside of circular seal 133 to minimize the accumulation of air/fuel mixture and exhaust gases between seal 119 and body 56, and to shield seal 133 from radiation heat transfer during combustion. Seal 133 and band 134 reduce the quenched volumes of the valve assembly. Alternatively, a split ring located in an annular groove in body 56 around chamber 108 engageable with segment body 121 and a spring in the groove can be used to hold segment body 121 in engagement with sleeve 28. The split ring can be used in conjunction with a continuous ring seal element.

Figure 11:
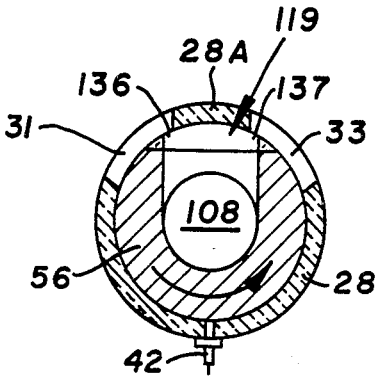
FIGS. 11 to 16 are diagrammatic views showing the rotary valve assembly porting events of the internal combustion engine of FIG. 1.

The sequence of events of valve assembly 24 are diagrammatically illustrated in FIGS. 11 to 16. FIG. 11 shows valve body 56 being rotated in a counter clockwise direction as indicated by the arrow. The valving combustion chamber 108 and segment seal 119 are located adjacent to intermediate segment 28A of sleeve 28 between intake port 31 and exhaust port 33. Valving combustion chamber 108 is larger than segment 28A providing for overlap openings 136 and 137 for the intake and exhaust ports 31 and 33 respectively. The overlap allows the intake gases to purge exhaust gases from the valving combustion chamber 108. The amount of overlap and the timing of the intake and exhaust episodes can be altered by changing the length of the intake and exhaust ports 31 and 33. In other words, the sleeve port edges can be changed to determine the timing of the valving events including the beginning of the intake, the end of the intake, the beginning of the exhaust and the end of the exhaust events. These alterations are made during the fabrication of the engine to provide an engine that has an optimum efficiency at a selected speed.

Figure 12:
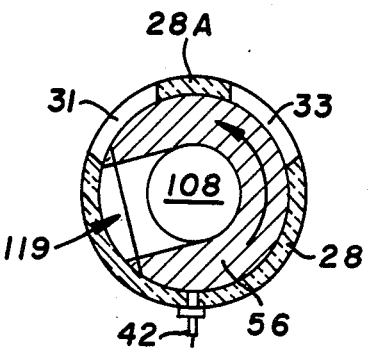
Figure 13:
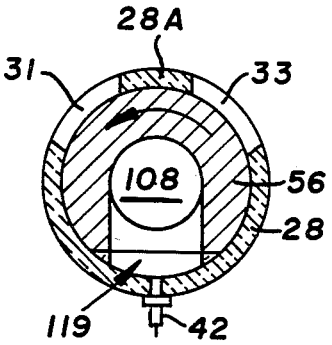
Figure 14:
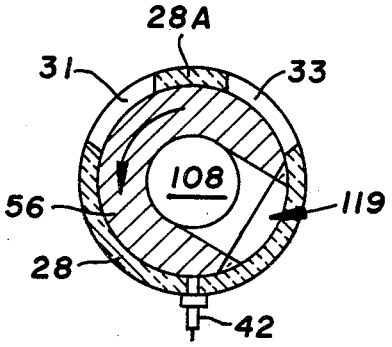
Figure 15:
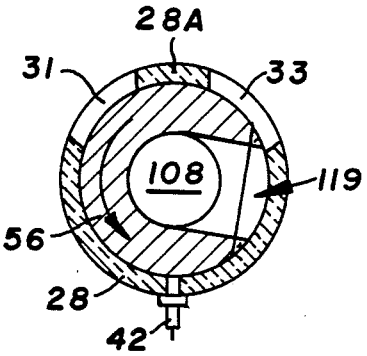
Figure 16:
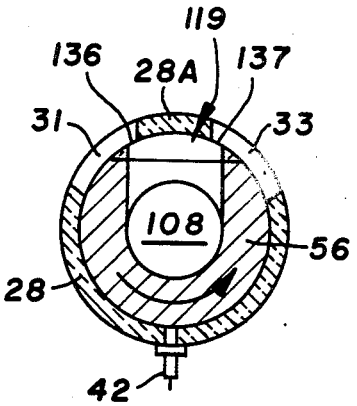

FIG. 12 shows valve body 56 at the completion of the intake stroke and the commencement of the compression stroke of the engine. The compression stroke is completed when valving body 56 is moved to the position shown in FIG. 13. The valving combustion chamber 108 is in alignment with the spark plug 42 and/or fuel injector. Spark plug 42 ignites the air/fuel mixture in valving combustion chamber 108 to commence the power or expansion stroke of the piston. FIG. 14 shows the position of valve body 56 during the power stroke. FIG. 15 shows the position of the valve body 56 during the opening episode of exhaust port 33. The valve body 56 continues to rotate whereby the exhaust gases are vented via exhaust port 33. FIG. 16 shows the position of valve body 56 at the completion of the exhaust stroke.

The ignition electrodes of spark plug 42 are shielded from the air/fuel mixture during compression thereof in the valving combustion chamber 108. The only time that the spark plug 42 is exposed to the valving combustion chamber 108 is when valve body 56 is in the position shown in FIG. 13. This provides a shielding of hot spot sources which reduces pre-ignition and/or detonation. The rotating valve body 56 with valving combustion chamber 108 provides for stratification of the air/fuel mixture due to the centrifugal effects of the richer portion of the mixture toward spark plug 42. This improves the lean burn combustion of the air/fuel mixture in valving combustion chamber 108. The rotating valve body 56 also increases the turbulence of the air/fuel mixture which decreases the potential for detonation.

Piston 13 with its head projection 19 increases the compression ratio of the engine. Projection 19 also provides for turbulent movement of air/fuel mixture in valving combustion chamber 108. Piston 13 imparts squish turbulence of the air/fuel mixture above the piston as the piston approaches head plate 17. This reduces detonation and enhances the efficient combustion of the air/fuel mixture.

The pressure activated seals 61 and 119 operatively associated with rotating valve body 56 generate only the necessary sealing contact unit loads required to effect efficient seals. The seals 61 and 119 have a minimum of sliding friction while allowing for run-out or wear-in during the operation of the valve assembly. In use, the pressure active seals 61 and 119 are allowed to float with respect to the valve body 56. This provides for the economy of relaxed fabrication tolerances while accommodating thermal growth and valve assembly run-out. Seal 61 and 119 are located relative to the valve body 56 to allow clearance between valve body 56 and the inside surface 29 of sleeve 28 and head plate 17. This clearance or space 30 does not accommodate an air/fuel mixture thereby reducing the amount of quenched air/fuel mixture in valving combustion chamber 108, and reduces the bearing loads on shaft 69 by reducing the pressure loaded area of valve body 56.

The geometry of the valve assembly allows the intake and exhaust gases to flow to and from the working or piston chamber with minimal restrictions.

The rotary valve assembly 24 is designed to provide for direct removal from the head 21. This is accomplished by removing the drive shaft 77 along with the bevel gears 94, 98, 101, and 103 mounted thereon. Ring 38 is removed from head 21. The valve body 56, along with sleeve 28, can be withdrawn upwardly from the bore 23 in head 21. The spark plug support 48 is removed from the head to permit the removal of sleeve 28. This can be accomplished without removing intake and exhaust manifolds and the cooling system from the engine.

The initial installation and accumulated wear affects on the valve assemblies do not require adjustment. All the fits and clearances are established by manufacturing dimensions.

While there has been shown and described preferred embodiments of the internal combustion engine and rotary valve assembly, it is understood that changes in the structure, materials, and arrangement of structure can be made by those skilled in the art without departing from the invention. The invention is defined in the following claims.

The embodiments of the invention in which an exclusive property or privilege is claimed are defined as follows:

1. An internal combustion engine comprising: a block having at least one cylindrical wall surrounding a piston chamber, piston means located in said piston chamber, means operable to reciprocate the piston means in said chamber, head means mounted on the block covering said chamber, said head means having an air and fuel intake passage, an exhaust gas passage, a rotary valve assembly operatively associated with the head means for controlling the flow of air and fuel into the rotary valve assembly and piston chamber and the flow of exhaust gas from rotary valve assembly and the piston chamber, said head means having a housing with a bore open to the piston chamber accommodating said rotary valve assembly, said valve assembly comprising a cylindrical sleeve located in said bore, said sleeve having an inner surface, an ignition hole, and intake and exhaust ports aligned with said intake passage and exhaust gas passage, spark generating means mounted on the housing operable to generate a spark, rotatable valving means located within said sleeve for controlling the flow of air and fuel into said rotary valve assembly and piston chamber and the flow of exhaust gases out of the rotary valve assembly and piston chamber, said rotatable valving means having a valving combustion chamber open to the piston chamber and the inner surface of the sleeve, said rotatable valving means having a valve body, said valving combustion chamber having an inner portion located in the valve body, said valve body having an outer surface spaced from the inner surface of the sleeve, seal means mounted on the valve body, said seal means having a hole aligned with an outer portion of the valving combustion chamber, biasing means located between the valve body and seal means to bias the seal means into engagement with the inner surface of the sleeve, and means operable to rotate said rotatable valving means in timed relation with the movement of the piston means whereby said engine has an intake, compression, power, and exhaust strokes.

2. The engine of claim 1 wherein: the cylindrical sleeve is a ceramic member.

3. The engine of claim 1 wherein: the seal means is a ceramic member.

4. The engine of claim 1 wherein: the cylindrical sleeve has a cylindrical inside surface and the seal means is a seal member having an outside surface portion engageable with the inside surface of the sleeve.

5. The engine of claim 4 wherein: said seal member has a first outside surface portion surrounding the outer portion of the valving combustion chamber engageable with the inside surface of the sleeve, and a second outside surface portion adjacent the first outside surface portion spaced from said inside surface of the sleeve.

6. The engine of claim 4 wherein: said valve body has a circumferential outwardly directed upper lip and a lower lip, and grooves on opposite sides of the valving combustion chamber extended between said upper and lower lips, said seal means comprising a seal member having tongues located in said grooves and an arcuate outer surface, said outer surface having a first surface portion surrounding the outer portion of the valving combustion chamber engageable with the inner surface of the sleeve and a second surface portion located outwardly of the first surface portion spaced from the inner surface of the sleeve.

7. The engine of claim 6 wherein: the biasing means includes circular seal means surrounding the valving combustion chamber and engageable with said valve body and member to bias the first portion of the outer surface into engagement with the inner surface of the sleeve.

8. The engine of claim 7 including: a ring shield located inwardly of the circular seal means between the valve body and member.

9. The engine of claim 6 wherein: the seal member is a one-piece ceramic member.

10. The engine of claim 1 including: a head plate located between said block and head means, said head plate having an opening for each piston chamber aligned with the valving combustion passage in the valve body.

11. The engine of claim 10 including: annular seal means between the head plate and valve body, said annular seal means surrounding said opening.

12. The engine of claim 11 wherein: said annular seal means includes an annular face seal engageable with the valve body and a seal member for biasing the face seal into engagement with the valve body.

13. The engine of claim 10 wherein: the piston means has an upright projection locatable in said opening when the piston means has completed the compression stroke.

14. The engine of claim 1 including: bearing means rotatably mounting the valve body on the head means for rotation along the general longitudinal axis of the piston means, said bearing means including a thrust bearing operable to retain the valve body within said sleeve.

15. An internal combustion engine comprising: a block having at least one cylindrical wall surrounding a piston chamber, piston means located in said piston chamber, means operable to reciprocate the piston means in said piston chamber, head means mounted on the block covering said chamber, said head means having an air and fuel intake passage and an exhaust gas passage, a rotary valve assembly operatively associated with the head means for controlling the flow of air and fuel into the piston chamber and the flow of exhaust gases from the piston chamber, said head means having a housing with a cylindrical inner surface surrounding a bore open to the piston chamber accommodating said valve assembly, said intake and exhaust gas passages being open to the side of said bore, rotatable valving means located within said bore for controlling the flow of air and fuel into said piston chamber and the flow of exhaust gases out of the piston chamber, said rotatable valving means having a valving combustion chamber open to the piston chamber and the inner surface, spark generating means mounted on the housing operable to generate a spark to ignite the fuel in said valving combustion chamber, said rotatable valving means having a valve body, said valving combustion chamber having an inner portion located in the valve body open to the piston chamber, said valve body having an outer surface spaced from the inner surface, seal means mounted on the valve body, said seal means having a hole aligned with an outer portion of the valving combustion chamber, biasing means located between the valve body and seal means to bias the seal means into sealing engagement with the inner surface, a head plate located between said block and head means, said head plate having an opening for each piston chamber aligned with the valving combustion chamber in the valve body, and means operable to rotate said rotatable valving means in timed relation with the movement of the piston means whereby said engine has intake, compression, power, and exhaust strokes.

16. The engine of claim 15 wherein: the seal means is a ceramic member.

17. The engine of claim 15 wherein: said seal means is a member having a first outside surface portion surrounding the outer portion of the valving combustion chamber engageable with the inside surface, and a second outside surface portion adjacent the first outside surface portion spaced from said inside surface.

18. An internal combustion engine comprising: a block having at least one cylindrical wall surrounding a piston chamber, piston means located in said piston chamber, means operable to reciprocate the piston means in said piston chamber, head means mounted on the block covering said chamber, said head means having an air and fuel intake passage and an exhaust gas passage, a rotary valve assembly operatively associated with the head means for controlling the flow of air and fuel into the piston chamber and the flow of exhaust gases from the piston chamber, said head means having a housing with a cylindrical inner surface surrounding a bore open to the piston chamber accommodating said valve assembly, said intake and exhaust gas passages being open to the side of said bore, rotatable valving means located within said bore for controlling the flow of air and fuel into said piston chamber and a flow of exhaust gases out of the piston chamber, said rotatable valving means having a valving combustion chamber open to the piston chamber and the inner surface, spark generating means mounted on the housing operable to generate a spark to ignite the fuel in said valving combustion chamber, said rotatable valving means having a body, said valving combustion chamber having an inner portion located in the body open to the piston chamber, said body having an outer surface spaced from the inner surface, a circumferential outwardly directed upper lip and a lower lip, and grooves on opposite sides of the valving combustion chamber extended between said upper and lower lips, seal means mounted on the body, said seal means having a hole aligned with an outer portion of the valving combustion chamber, said seal means comprising a member having tongues located in said grooves and an arcuate outer surface, said outer surface having a first surface portion surrounding the outer portion of the valve passage engageable with the inner surface and a second surface portion located outwardly of the first surface portion spaced from the inner surface, biasing means located between the body and seal means to bias the seal means in sealing engagement with the inner surface, and means operable to rotate said valving means in timed relation with the movement of the piston means whereby said engine has intake, compression, power, and exhaust strokes.

19. The engine of claim 18 wherein: the biasing means includes circular seal means surrounding the valving passage and engageable with said valve body and member to bias the first portion of the outer surface into sealing engagement with the inner surface.

20. The engine of claim 19 including: a ring shield located inwardly of the circular spring means between the valve body and member.

21. The engine of claim 15 including: annular seal means between the head plate and valve body, said annular seal means surrounding said opening.

22. The engine of claim 21 wherein: the annular seal means includes an annular face seal engageable with the valve body and a seal member for biasing the face seal into engagement with the valve body.

23. The engine of claim 15 wherein: the piston means has an upright projection locatable in said opening when the piston means has completed the compression stroke.

24. The engine of claim 15 including: bearing means rotatably mounting the valve body on the head means for rotation along the general longitudinal axis of the piston means, said bearing means including a thrust bearing operable to retain the valve body within said bore.

25. An internal combustion engine comprising: a block having cylindrical walls surrounding piston chambers, piston means located in said piston chambers, means operable to reciprocate the piston means in said chambers, a head plate located on the block over the piston chambers, said head plate having openings in communication with said chambers, head means mounted on the head plate covering said openings, said head means having an air and fuel intake passage, an exhaust gas passage, rotary valve assemblies operatively associated with the head means for controlling the flow of air and fuel into said piston chambers and the flow of exhaust gas from said piston chambers, said head means having a housing with inner surfaces and bores open to said piston chambers accommodating said valve assemblies, each of said valve assemblies having a body located in a bore, said body having a valving combustion chamber continuously open to said opening and sequentially open to said air and fuel intake passage and exhaust gas passage, said body having an outer surface spaced from the housing, annular first seal means surrounding said valving combustion chamber between said body and said head plate, second seal means mounted on the valve body, said seal means having a hole aligned with an outer portion of the valving combustion chamber, means mounted on the housing operable to initiate combustion of the air and fuel mixture in said valving combustion chamber, and means operable to rotate each of said valving bodies in timed relation with the movement of the piston means whereby said engine has an intake, compression, power and exhaust strokes.

26. The engine of claim 25 wherein: said second seal means includes a seal member having a first outside surface portion surrounding the outer portion of the valving combustion chamber engageable with the inside surface, and a second outside surface portion adjacent the first outside surface portion spaced from said inside surface.

27. The engine of claim 26 wherein: said body has a circumferential outwardly directed upper lip and a lower lip, and grooves on opposite sides of the valving combustion chamber extended between said upper and lower lips, said second seal means comprising a member having tongues located in said grooves and an arcuate outer surface, said outer surface having a first surface portion surrounding the outer portion of the valving combustion chamber engageable with the inner surface and a second surface portion located outwardly of the first surface portion spaced from the inner surface.

28. The engine of claim 27 including: circular seal means surrounding the valving combustion chamber and engageable with said body and member to bias the first portion of the outer surface into engagement with the inner surface.

29. The engine of claim 28 wherein: the seal means includes an annular face seal engageable with the valve body and a seal member for biasing the face seal into engagement with the valve body.

30. The engine of claim 25 wherein: each piston means has an upright projection locatable in said opening when the piston means has completed the compression stroke.

31. The engine of claim 25 including: a cylindrical sleeve having said inner surface, an intake port aligned with the intake passage, an exhaust port aligned with the exhaust passage and an ignition hole open to said inner surface, said body being located within said sleeve with the outside surface of the body being spaced from said inner surface, said second seal means being engageable with said inner surface.

32. A head for an apparatus having a block, a cylinder having a piston chamber accommodating at least one reciprocating piston comprising: housing means having a bore open to the piston chamber when the housing means is mounted on the block, said housing means having an intake passage and an exhaust passage open to the bore, continuous sleeve means located in said bore, said sleeve means having a cylindrical inside surface, an intake port and an exhaust port, means holding the sleeve means on the housing means to register the intake part with the intake passage and exhaust port with the exhaust passage, rotatable valving means locating within said sleeve means, said valving means having a valving combustion chamber open to the piston chamber and the inside surface of the sleeve means, said valving means having a valve body, said valve body having an outer surface spaced from the inner surface of the sleeve, seal means mounted on the valve body for rotation therewith, said seal means having a hole aligned with an outer portion of the valving combustion chamber, means located between the valve body and seal means to hold the seal means into engagement with the inner surface of the sleeve, and means for rotating said valve body in timed relation with respect to the movement of the piston whereby said valving combustion chamber sequentially moves into alignment with the intake port and exhaust port so that gas is moved into and out of the piston and valving combustion chambers in response to the reciprocal movement of the piston.

33. The head of claim 32 wherein: said sleeve means includes an ignition hole, and spart generating means mounted on the housing means operable to generate a spark in said valving passage.

34. The head of claim 32 wherein: the sleeve means is a cylindrical ceramic member.

35. The head of claim 32 wherein: the cylindrical sleeve means has a cylindrical inside surface and the seal means is a member having an outside surface portion engageable with the inside surface of the sleeve.

36. The head of claim 35 wherein: said member has a first outside surface portion surrounding the outer portion of the valving passage engageable with the inside surface of the sleeve means, and a second outside surface portion adjacent the first outside portion spaced from said inside surface of the sleeve means.

37. A head for an apparatus for having a block, a cylinder having a piston chamber accommodating at least one reciprocating piston comprising: housing means having a bore open to the piston chamber when the housing means is mounted on the block, said housing means having an intake passage and an exhaust passage open to the bore, continuous sleeve means located in said bore, said sleeve means having a cylindrical inside surface, an intake port and exhaust port, means holding the sleeve means on the housing to register the intake port with the intake passage and exhaust port with the exhaust port passage, rotatable valving means located within said sleeve, said valving means having a valving combustion chamber open to the piston chamber and the inside surface of the sleeve means, said valving means having a valve body, said valve body having an outer surface spaced from the inner surface of the sleeve, a circumferentially outwardly directed upper lip and a lower lip, and grooves on opposite sides of the valve passage extended between said upper and lower lips, seal means mounted on the valve body for rotation therewith, said seal means having a hole aligned with an outer portion of the valving combustion chamber, said seal means comprising a seal member having tongues located in said grooves and an arcuate outer surface, means located between the valve body and seal means to hold the seal means in engagement with the inner surface of the sleeve, and means for rotating said valve body in timed relation with respect to the movement of the piston whereby said valving combustion chamber sequentially moves into alignment with the intake port and exhaust port so that gases move into and out of piston and valving combustion chambers in response to the reciprocal movement of the piston.

38. The head of claim 37 wherein: said outer surface has a first surface portion surrounding the outer portion of the valving combustion chamber engageable with the inner surface of the sleeve means and a second surface portion located outwardly of the first surface portion spaced from the inner surface of the sleeve means.

39. The head of claim 38 including: circular seal means surrounding the valving combustion chamber and engageable with said valve body and member to bias the first portion of the outer surface into sealing engagement with the inner surface of the sleeve means.

40. The head of claim 39 including: a ring shield located inwardly of the circular seal means between the valve body and member.

41. The head of claim 39 wherein: the seal means includes an annular face seal engageable with the valve body and a seal member for biasing the face seal into engagement with the valve body.

42. A head for an apparatus having a block, a cylinder having a piston chamber accommodating at least one reciprocating piston comprising: housing means having a bore open to the piston chamber when the housing means is mounted on the block, said housing means having an intake passage and an exhaust passage open to the bore, continuous sleeve means located in said bore, said sleeve means having a cylindrical inside surface, an intake port and an exhaust port, means holding the sleeve means on the housing means to register the intake port with the intake passage and exhaust port with the exhaust passage, rotatable valving means located within said sleeve means, said valving means having a valving combustion chamber open to the piston chamber and the inside surface of the sleeve means, said valving means having a valve body, said valve body having an outer surface spaced from the inner surface of the sleeve, seal means mounted on the valve body for rotation therewith, said seal means having a hole aligned with an outer portion of the valving combustion chamber, means located between the valve body and seal means to hold the seal means into engagement with the inner surface of the sleeve, and means for rotating said valve body in timed relation with respect to the movement of the piston whereby said valving combustion chamber sequentially moves in alignment with the intake port and exhaust port so that gas is moved into and out of the piston and valving combustion chambers in response to the reciprocal movement of the piston, said head includes a head plate located adjacent the housing means, said head plate having an opening for each combustion chamber aligned with the valving combustion chamber and the valve body.

43. The head of claim 42 including: annular seal means between the head plate and valve body, said annular seal means surrounding said opening.

44. The head of claim 43, wherein: the seal means includes an annular face seal engageable with the valve body and a seal member for biasing the face seal into engagement with the valve body.

45. The head of claim 32 including: bearing means rotatably mounting the valve body on the housing means for rotation along the general longitudinal axis of the bore, said bearing means including a thrust bearing operable to retain the valve body within said sleeve means.

46. A rotary valve assembly comprising: a housing having a bore, a gas inlet passage and a gas outlet passage open to the bore, a continuous cylindrical sleeve means located in said bore, said sleeve means having an inner surface and ports aligned with said passage, rotatable valving means located within said sleeve means for controlling the flow of gas into and out of the assembly, said rotatable valving means having a valving chamber open to means to accommodate a gas and the inner surface of the sleeve means, said rotatable valving means having a valve body, said valving chamber having an inner portion located in the valve body, said valve body having an outer surface spaced from the inner surface of the sleeve means, seal means mounted on the valve body for rotation therewith, said seal means being engageable with the inner surface of the sleeve means, said seal means having a hole aligned with an outer portion of the valving chamber, said seal means having a first outside generally annular surface portion surrounding the outer portion of the valving second chamber, said annular surface portion being located in engagement with the inner surface of the housing, biasing means located between the valve body and seal means to hold the seal means into engagement with the inner surface of the sleeve means, and means operable to rotate said rotatable valving means whereby said valving passage sequentially moves into alignment with said ports allowing gas to flow in said inlet and outlet gas passages.

47. The assembly of claim 46 wherein: the cylindrical sleeve means is a ceramic member.

48. The assembly of claim 47 wherein: the seal means is a ceramic member.

49. The assembly of claim 46 wherein: the cylindrical sleeve means has a cylindrical inside surface and the seal means is a member having an outside surface portion engageable with the inside surface of the sleeve means.

50. The assembly of claim 49 wherein: said member has a second outside surface portion adjacent the first outside surface portion spaced from said inside surface of the sleeve means.

51. The assembly of claim 49 wherein: said valve body has a circumferential outwardly directed upper lip and a lower lip, and grooves on opposite sides of the valve passage extended between the upper and lower lips, said seal means comprising a member having tongues located in said grooves and an arcuate outer surface.

52. The assembly of claim 51 wherein: said arcuate outer surface has a first surface portion surrounding the outer portion of the valve passage engageable with the inner surface of the sleeve means and a second surface portion located outwardly of the first surface portion spaced from the inner surface of the sleeve means.

53. The assembly of claim 52 including: generally circular means surrounding the valving chamber and engageable with said valve body and member to bias the first portion of the outer surface into engagement with the inner surface of the sleeve means.

54. The assembly of claim 53 including: a ring shield located inwardly of the circular means between the valve body and member.

55. The assembly of claim 53 wherein: the generally circular means includes an annular face seal engageable with the valve body and a seal member for biasing the face seal into engagement with the valve body.

56. The assembly of claim 46 including: bearing means rotatably mounting the valve body on the housing for retaining the body within said sleeve means.

57. A rotary valve assembly comprising: housing means having an inner surface surrounding a first chamber and gas inlet and outlet ports open to the chamber to carry gas to and from the chamber, rotatable means located within the chamber for controlling the flow of gas into and out of the assembly, said rotatable valving means having a valving second chamber open to means to accommodate a gas and said first chamber, said rotatable valving means having a valve body, said valve body having an outer surface spaced from the inner surface, seal means having a hole in communication with the second chamber mounted on the valve body engageable with said inner surface, said seal means having a first outside generally annular surface portion surrounding the outer portion of the valving second chamber, said annular surface portion being located in engagement with the inner surface of the housing means, biasing means located between the valve body and seal means to hold the annular surface portion of the seal means in engagement with the inner surface of the housing means, and means operable to rotate said valve body whereby said valving second chamber sequentially moves into alignment with said ports allowing gas to flow in said gas inlet and outlet ports.

58. The assembly of claim 57 wherein: the seal means is a ceramic member.

59. The assembly of claim 57 wherein: said seal means has a second outside surface portion adjacent the first outside surface portion spaced from said inner surface of the housing means.

60. The assembly of claim 57 wherein: said valve body has a circumferential outwardly directed upper lip and a lower lip, and grooves on opposite sides of the valving second chamber extended between the upper and lower lips, said seal means comprising a member having tongues located in said grooves and an arcuate outer surface.

61. The assembly of claim 60 wherein: said arcuate outer surface has a first surface portion surrounding the outer portion of the valving second chamber engageable with the inner surface, and a second surface portion located outwardly of the first surface portion spaced from the inner surface.

62. The assembly of claim 61 including: circular seal means surrounding the valving second chamber and engageable with said valve body and member to bias the first portion of the outer surface into engagement with the inner surface.

63. The assembly of claim 62 including: a ring seal located inwardly of the circular spring means between the valve body and member.

64. An internal combustion engine comprising: a block having cylindrical walls surrounding piston chambers, piston means located in said piston chambers, means operable to reciprocate the piston means in said chambers, a head plate located on the block over the piston chambers, said head plate having openings in communication with said chambers, head means mounted on the head plate covering said openings, said head means having an air intake passage, an exhaust gas passage, rotary valve assemblies operatively associated with the head means for controlling the flow of air into said piston chambers and the flow of exhaust gas from said piston chambers, said head means having a housing with inner surfaces and bores open to said pistons, chambers accommodating said valve assemblies, each of said valve assemblies having a body located in a bore, said body having a valving combustion chamber continuously open to said opening and sequentially open to said air intake passage and exhaust gas passage, said body having an outer surface spaced from the housing, annular first seal means surrounding said valving combustion chamber between said body and said head plate, second seal means mounted on the valve body, said seal means having a hole aligned with an outer portion of the valving combustion chamber, means mounted on the housing operable to introduce fuel into the valving combustion chamber, and means operable to rotate each of said valve bodies in timed relation with the movement of the piston means whereby said engine has an intake, compression, power, and exhaust strokes.

65. The engine of claim 64 wherein: said second seal means includes a seal member having a first outside surface portion surrounding the outer portion of the valving combustion chamber engageable with the inside surface, and a second outside surface portion adjacent the first outside surface portion spaced from said inside surface.

66. The engine of claim 65 wherein: said body has a circumferential outwardly directed upper lip and a lower lip, and grooves on opposite sides of the valve passage extended between said upper and lower lips, said second seal means comprising a member having tongues located in said grooves and an arcuate outer surface, said outer surface having a first surface portion surrounding the outer portion of the valving combustion chamber engageable with the inner surface and a second surface portion located outwardly of the first surface portion spaced from the inner surface.

67. The engine of claim 64 including: circular seal means surrounding the valving combustion chamber and engageable with said body and member to bias the first portion of the outer surface into engagement with the inner surface.

68. The engine of claim 67 wherein: the annular seal means includes an annular face seal engageable with the valve body and a seal member for biasing the face seal into engagement with the valve body.

69. The engine of claim 68 including: a ring shield located inwardly of the annular seal means between the valve body and member.

70. The engine of claim 64 wherein: each piston means has an upright projection locatable in said opening when the piston means has completed the compression stroke.

71. The engine of claim 64 including: a cylindrical sleeve having said inner surface, an intake port aligned with the intake passage, an exhaust port aligned with the exhaust passage and an ignition hole to open to said inner surface, said body being located within said sleeve with the outside surface of the body being spaced from said inner surface, said second seal means being engageable with said inner surface.

* * * * *